US006498826B2

(12) United States Patent
Gluschke et al.

(10) Patent No.: US 6,498,826 B2
(45) Date of Patent: Dec. 24, 2002

(54) STORAGE/TRANSPORT CONTAINER FOR RADIOACTIVE MATERIAL

(75) Inventors: Konrad Gluschke, Wickede (DE); Rudolf Diersch, Essen (DE); Dieter Methling, Hattingen (DE)

(73) Assignee: GNB Gesellschaft fur Nuklear-Behalter mbH, Essen (DE)

( * ) Notice: Subject to any disclaimer, the term of this patent is extended or adjusted under 35 U.S.C. 154(b) by 0 days.

(21) Appl. No.: 09/728,603

(22) Filed: Dec. 1, 2000

(65) Prior Publication Data

US 2001/0015989 A1 Aug. 23, 2001

(30) Foreign Application Priority Data

Dec. 15, 1999 (EP) ..... 99125002

(51) Int. Cl.[7] ..... G21C 19/07
(52) U.S. Cl. ..... 376/260; 376/272; 250/506.1
(58) Field of Search ..... 376/272, 285, 376/260; 250/515.1, 517.1, 518.1, 506.1, 507.1

(56) References Cited

U.S. PATENT DOCUMENTS 3,005,105 A * 10/1961 Lusk ..... 250/506.1
3,780,306 A * 12/1973 Anderson et al. ..... 250/428
5,641,970 A * 6/1997 Taniuchi et al. ..... 250/506.1
5,887,042 A * 3/1999 Akamatsu et al. ..... 376/272
5,909,475 A * 6/1999 Wells et al. ..... 376/272
6,187,395 B1 * 2/2001 Canzler et al. ..... 428/34.1
6,389,093 B1 * 5/2002 Gluschke et al. ..... 376/272

FOREIGN PATENT DOCUMENTS

DE 28 17 193 10/1979 ..... 376/272
JP 09-171094 * 6/1997 ..... 376/272

* cited by examiner

*Primary Examiner*—Michael J. Carone
*Assistant Examiner*—Daniel Matz
(74) *Attorney, Agent, or Firm*—Herbert Dubno; Andrew Wilford

(57) ABSTRACT

A storage/transport container for radioactive material has a metallic outer shell, a metallic inner shell concentrically received in the outer cell and defining therewith an annular space, and an annular and continuous heat-conductive meander strip in the space. The strip is formed unitarily with a plurality of angularly spaced inner segments engaging the inner shell, respective angularly spaced outer segments engaging the outer shell, and respective generally radially extending webs extending between the inner and outer segments.

3 Claims, 4 Drawing Sheets

STORAGE/TRANSPORT CONTAINER FOR RADIOACTIVE MATERIAL

FIELD OF THE INVENTION

The present invention relates to a storage/transport container for radioactive material such as spent nuclear fuel rods. More particularly this invention concerns a method of making such a container.

BACKGROUND OF THE INVENTION

A standard container for nuclear waste products comprises an inner shell having a cylindrical side wall and planar floor, a similarly shaped outer shell spacedly surrounding the inner shell, a mass of concrete or the like in the space between the shells, and a cover. The material being stored or transported is loaded into the inner shell and the cover is installed. is The steel walls of the shells and the concrete between them provides shielding.

Heat evolves from the waste so that it is standard as described in German patent document 2,817,193 filed Apr. 20, 1978 by R. Christ to provide webs or struts of heat-conductive material between the inner and outer shells. Thus heat is conducted to the outer shell where it can dissipate to the atmosphere without overly heating the inner shell or the contents of the container.

Such containers are mass produced and, once filled, are normally not reused so that they must be made at the lowest possible cost. The main bottleneck in production is the laborious installation of the heat-dissipating webs between the shells.

OBJECTS OF THE INVENTION

It is therefore an object of the present invention to provide an improved method of making a storage/transport container for radioactive material.

SUMMARY OF THE INVENTION

A storage/transport container for radioactive material has according to the invention has a metallic outer shell, a metallic inner shell concentrically received in the outer cell and defining therewith an annular space, and an annular and continuous heat-conductive meander strip in the space. The strip is formed unitarily with a plurality of angularly spaced inner segments engaging the inner shell, respective angularly spaced outer segments engaging the outer shell, and respective generally radially extending webs extending between the inner and outer segments.

The meander strip, which is of constant width and thickness, can easily be formed into the desired shape at very low cost by a simple roll-stamping procedure. When fitted in the space between the inner and outer shells it forms an excellent heat-conducting bridge. There is no need to position individual elements in place and then individually secure them.

The inner segments according to the invention each have angularly spaced opposite ends from which the webs extend and which abut the ends of adjacent flanking inner segments. Thus the inner-segment ends can be joined together to form an inner ring tightly surrounding the inner shell which may be annularly continuous or split.

The container in accordance with the invention comprises a plurality of such strips axially offset from each other with the inside and outside segments of adjacent strips staggered angularly. Thus the concrete filling will extend continuously over the entire space between the shells, joined together axially of the container into a single mass in which the strip webs are imbedded.

The inner segments have a curvature corresponding to a curvature of an outer surface of the inner shell and the outer segments have a curvature corresponding to a curvature of an inner surface of the outer shell. This ensures excellent contact and good heat transfer from the inner shell to the outer shell. The webs are under prestress and press the segments against the respective shells to further augment the heat-conducting contact.

The inner and outer shells according to the invention have respective base plates spaced axially from each other. An array of metallic heat-conducting strips between the base plates have inner ends engaging the inner-shell base plate and outer ends engaging the outer shell. Thus even the floor of the inner shell is set up to conduct heat away from the charge in the container to the outer shell.

The storage/transport container according to the invention is made by first fitting around a metallic inner shell an annular and continuous heat-conductive meander strip having a plurality of angularly spaced inner segments engaging the inner shell, respective angularly spaced outer segments, and respective generally radially extending webs extending between the inner and outer segments. This meander strip may be fixed to the inner shell. Then the meander strip is radially inwardly compressed and the other shell is fitted over the inner shell and meander strip. Then the compression of the meander strip is released so that the outer segments bear on the outer shell. Finally a space between the inner and outer shells is filled with concrete. The radial compression of the radially elastically deforms the webs that stay radially slightly deformed in the finished container so that good contact with the outer shell is ensured.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
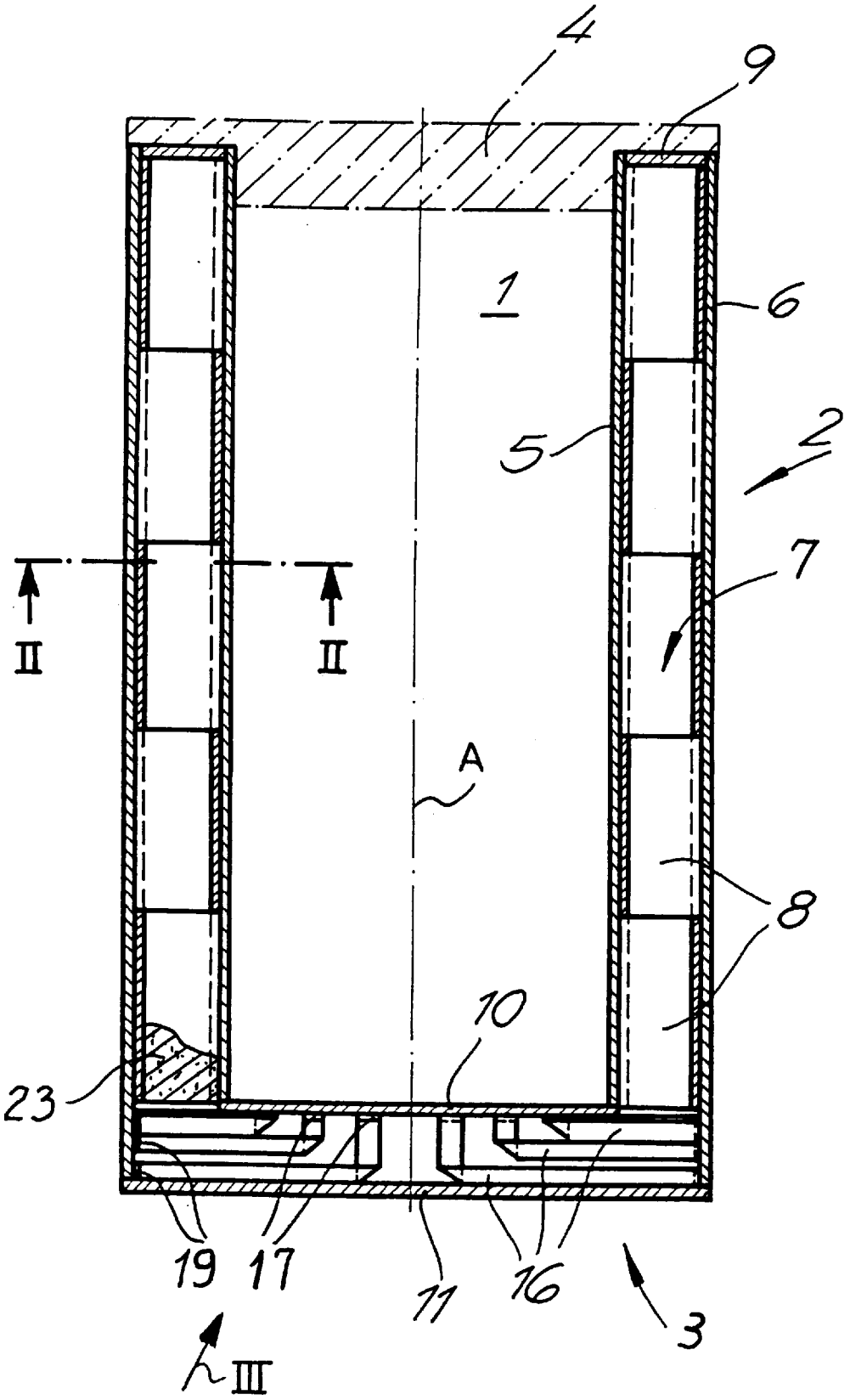
FIG. 1 is a small-scale axial section through the container according to the invention.
Figure 2:
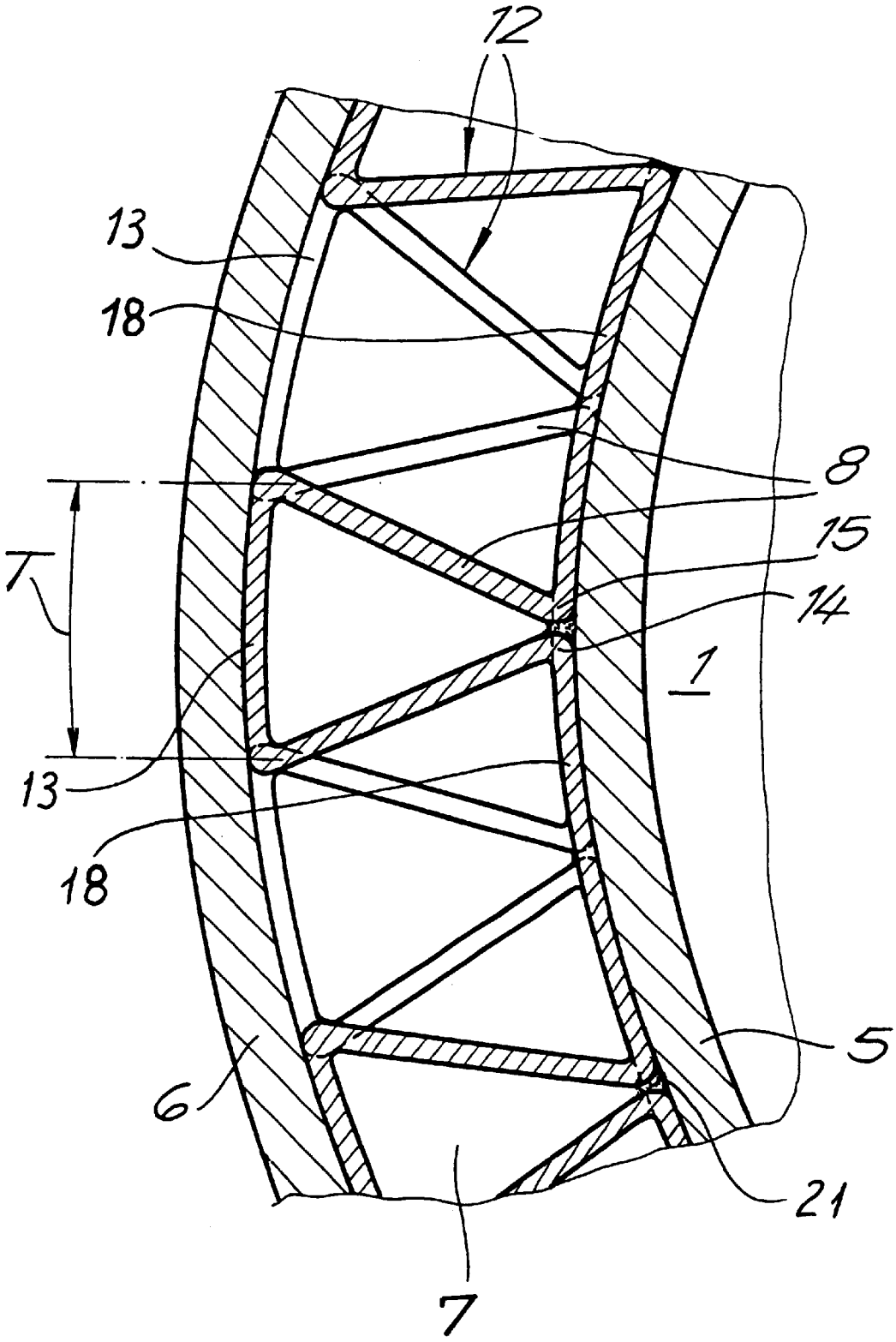
FIG. 2 is a section taken along line II—II of FIG. 1.

As seen in FIGS. 1 and 2 a transport/storage container has a side wall 2 with a base 3 and a lid 4 defining an interior 1 adapted to hold radioactive material such as spent nuclear-fuel rods. The side wall 2 is formed by a cylindrical inner sheetsteel shell 5 and a cylindrical outer sheet-steel shell 6 separated by a tubularly annular chamber or space 7 from the inner shell 5. The space 7 formed between the inner shell 5 and the outer shell 6 is filled with concrete shown partially at 23.

The inner shell 5 and the outer shell 6 are interconnected by generally radially extending heat-dissipating metal web elements 8. At the top of the container the inner shell 5 and the outer shell 6 are interconnected by an annular and planar steel ring 9 to which the inner shell 5 and the outer shell 6 are welded. The container base 3 consists of an inner base plate or disk 10 and an outer base plate or disk 11 made from sheet steel and spaced apart relative to an axis A of the container. The inner base 10 is welded to the inner shell 5 and the outer base 11 is welded to the outer shell 6.

As will be immediately apparent from a comparison of FIGS. 1 and 2, the metal elements 8 disposed between the inner shell 5 and the outer shell 6 are formed by webs of a plurality of open annular meander strips or rings 12 having inner segments 18 which bear against the inner shell 5 and outer segments 13 which bear against the outer shell 6. The segments 13 and 18 are arcuate to match the curvature of the respective inner and outer shells 5 and 6. Corners 14 and 15 of the inner segments 18 abut each other and are welded, brazed, or soldered together at 21. A plurality of these meander strips 12 are disposed one above the other, offset or angularly staggered relative to one another by a pitch T equal to the angular length of the outer segments 13 and also equal generally to an angular spacing between adjacent outer segments 13. The thickness of the meander strips 12 and webs 8 and of the connecting shoulders 13 is exaggerated in FIG. 2 for reasons of clarity.

Figure 3:
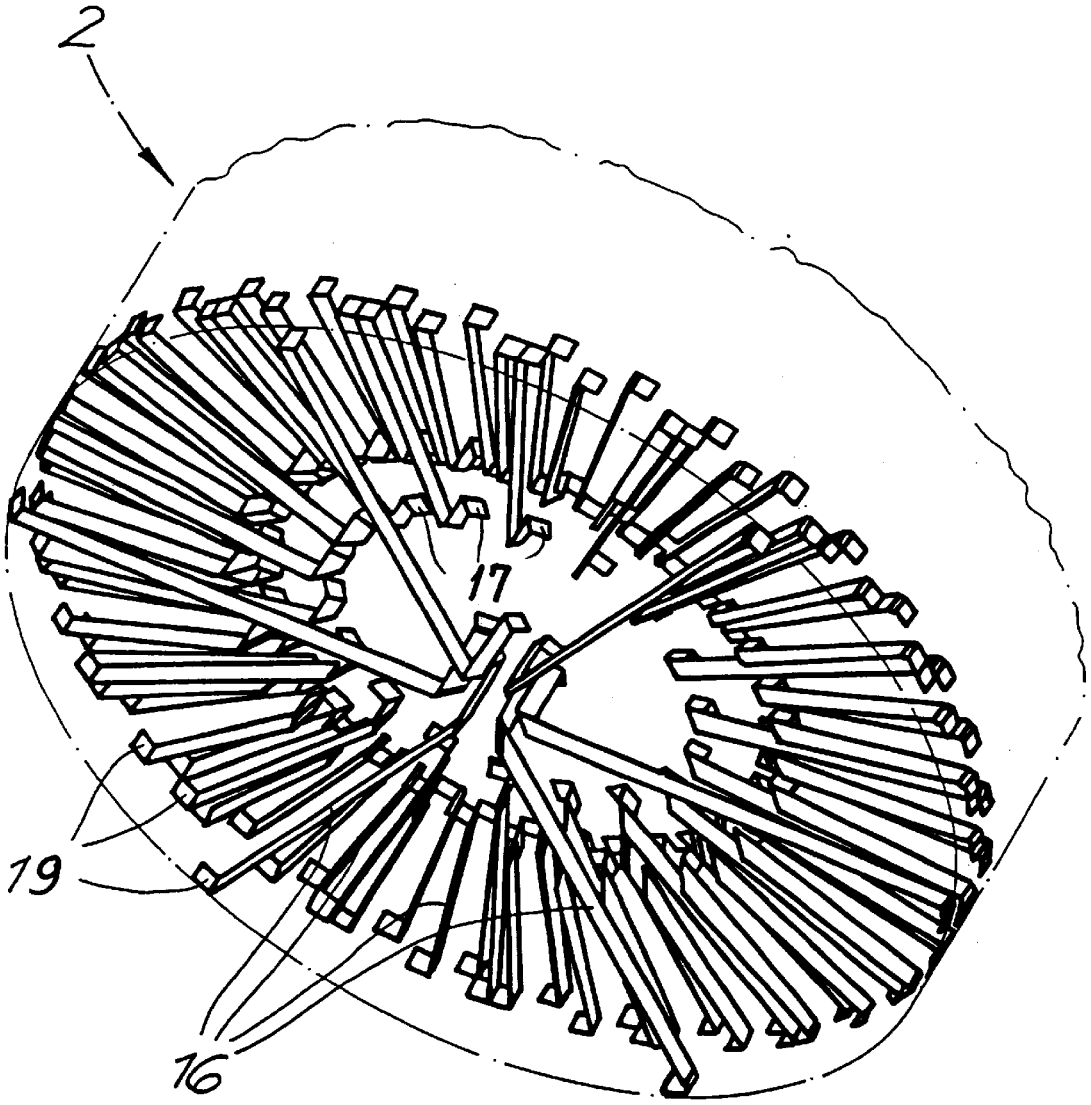
FIG. 3 is a view taken in the direction of arrow III of FIG. 1 with the outer shell shown in phantom lines for clarity of view.

FIG. 3 shows that heat-dissipating metal radial strips 16 are disposed between the inner base 10 and the outer base 11 and are connected to the inner base 10 of the inner shell 5 via end-face tabs 17. They are connected to the outer shell 6 by end tabs 19 because the container stands on the outer base 11 and hence practically no heat can be dissipated via the outer base disk 11. If the tabs 17 consist of a material which is not weldable to the material of the inner base 10 or outer shell 6, they can be connected by auxiliary elements which are welded on the inner base 10 or outer shell 6 and which press the tabs 17 or 19 against the respective part 6 or 10.

Figure 4:
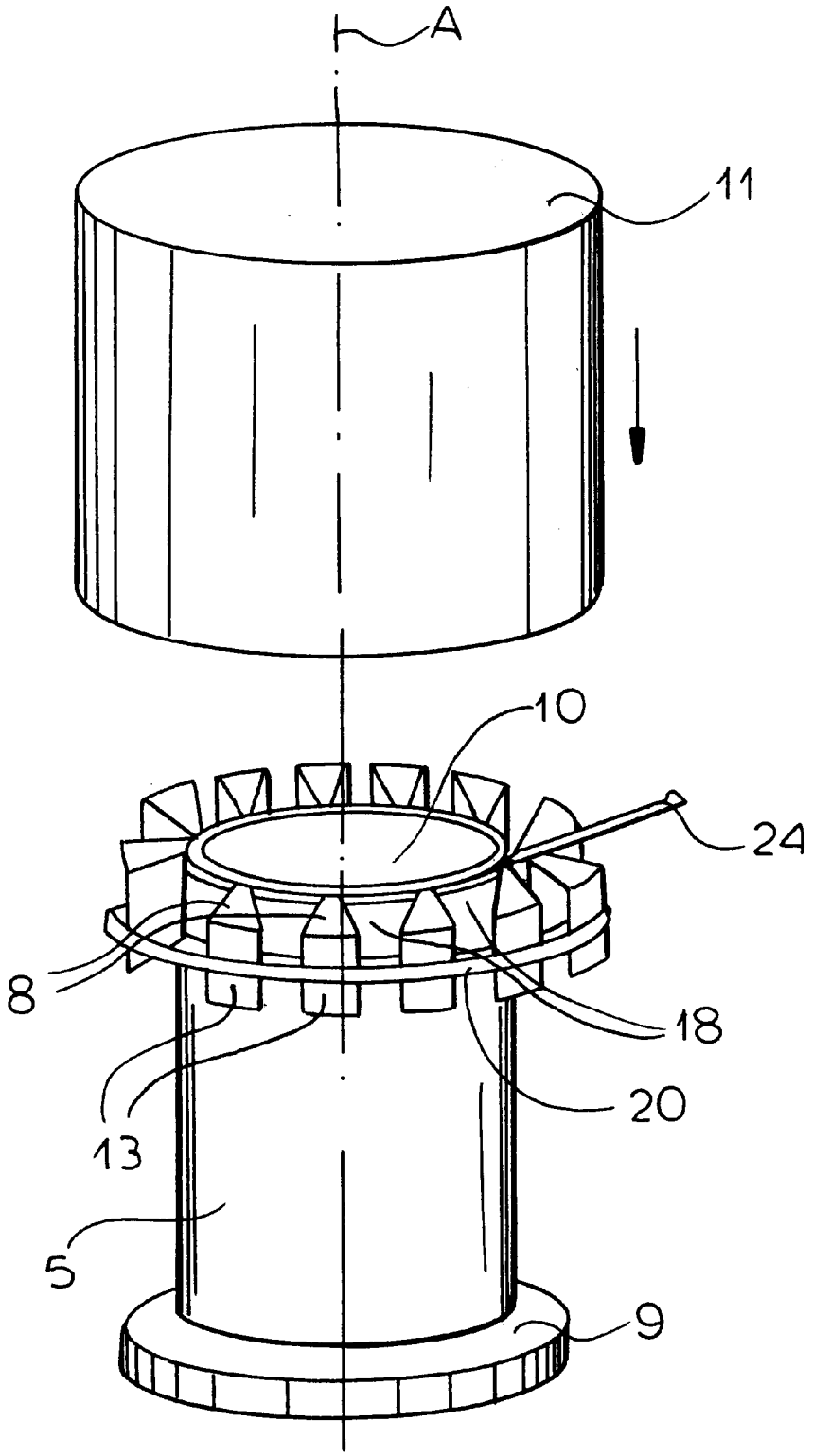
FIG. 4 is a small-scale diagrammatic view illustrating the manufacture of the container in accordance with the invention.

To manufacture the transport and/or storage container described, the inner shell 5 is welded as shown in FIG. 4 to the steel ring 9 and to the inner base 10 and set on the ground upside down, that is with the ring 9 down. The open meander strips 12 are then successively fitted onto the inner shell 5 and clamped to the inner shell 5 by means such as the belt clamp 20 to reduce the outside diameter of the respective meander strip 12 and are welded in place by a tool indicated schematically at 24. It is possible to reduce the outside diameter of the meander strip 12 because the webs 8 of the meander strips 12 can be elastically deformed. Consecutive meander strips 12 are arranged in offset relationship by the pitch T. The outer shell 6 is then fitted initially over part of the top meander strip 12 as far as the associated clamp ring 20 allows and then the ring 20 is released. The procedure is the same for the next meander strips 12 until the outer shell 6 bears against the steel ring 9 and can also be welded thereto. The concrete 23 is then introduced and the container is closed by welding the outer shell 11 on.

We claim:

1. A method of making a storage/transport container for radioactive material, the method comprising the steps of sequentially:

fitting around a metallic inner shell an annular and continuous heat-conductive meander strip having a plurality of angularly spaced inner segments engaging the inner shell, respective angularly spaced outer segments, and respective generally radially extending webs extending between the inner and outer segments;

radially inwardly compressing the meander strip;

fitting an outer shell over the inner shell and meander strip;

releasing compression of the meander strip so that the outer segments bear on the outer shell; and filling a space between the inner and outer shells with concrete.

2. The container-making method defined in claim 1 wherein a plurality of such strips are fitted to the inner shell and sequentially compressed and released as the outer shell is fitted over the inner shell and strips fitted thereto.

3. The container-making method defined in claim 1 wherein radial compression of the strip radially elastically deforms the webs.

* * * * *